US006669408B1

(12) United States Patent
Woodall et al.

(10) Patent No.: US 6,669,408 B1
(45) Date of Patent: Dec. 30, 2003

(54) SELF-ORIENTING PILING, FLUID-FLOW REDUCTION DEVICE

(75) Inventors: Robert Woodall, Panama City Beach, FL (US); Felipe Garcia, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/145,147

(22) Filed: May 13, 2002

(51) Int. Cl.[7] ..... F15D 1/10
(52) U.S. Cl. ..... 405/211; 114/243
(58) Field of Search ..... 405/211–216; 114/219, 220, 243

(56) References Cited

U.S. PATENT DOCUMENTS 2,435,956 A * 2/1948 Craig ..... 114/243
3,241,513 A * 3/1966 Rather et al. ..... 114/243
3,859,949 A * 1/1975 Toussaint et al. ..... 114/243
5,456,199 A * 10/1995 Kernkamp ..... 114/243 X
5,722,340 A * 3/1998 Sweetman ..... 114/243

* cited by examiner

*Primary Examiner*—Heather Shackelford
*Assistant Examiner*—Sunil Singh
(74) *Attorney, Agent, or Firm*—Harvey A. Gilbert; Donald G. Peck

(57) ABSTRACT

A load reduction device is mounted on a piling to reduce flow-drag created by fluid flowing on and past the piling. Upper and lower collars engage the piling to support and guide a bi-directionally tapered hydrodynamic foil having a tapered leading vane portion and tapered trailing vane portion extending between the collars. The bi-directionally tapered hydrodynamic foil is rotatably supported in the collars to permit its rotation about the longitudinal axis of the piling. The tapered trailing vane portion has an extended tapered shape to orient the leading edge of the tapered leading vane portion into the direction of flowing fluid and reduce hydrodynamic drag on the piling. Load reduction devices of this invention can reduce the loads on pilings attributed to flowing water by at least two hundred percent for a given set of hydrodynamic flow conditions.

10 Claims, 4 Drawing Sheets

SELF-ORIENTING PILING, FLUID-FLOW REDUCTION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a device for increasing the survivability of pilings in flowing water. More particularly, this invention provides hydrodynamic structure to reduce the drag load on pilings in flowing water.

Many, many commercial and military structures and facilities are located along the coasts of the United States and abroad, and piling supported oilrigs, observation platforms, and anchoring posts are dispersed in offshore waters. In addition, significant numbers of homes and military installations are found along shores, in harbors, and along flowing waterways. Many of these constructions are supported on pilings in order to keep them away from potentially rising floodwaters.

Structures built on pilings are designed to withstand the hydrodynamic forces that they are likely to encounter during their life cycle. Often these life cycle and design considerations revolve around what is known as the one-hundred-year flood or one-hundred-year storm. That is, the supporting piling foundation is built such that the protected structure is raised above the potential of the one-hundred-year flood or storm. The piling foundation is also made with sufficient strength to withstand the hydrodynamic forces that accompany rapidly moving water and wind about it. Unfortunately, as has been discovered during recent years, the one-hundred-year storm can strike at any time and can strike during consecutive periods of less than one hundred years. When such events occur, the design and strength of the piling foundations are tested to their limits and quite often fail.

The major cause of this failure is due to moving water and the tremendous hydrodynamic forces that this moving water places on the pilings that support various structures. During a hurricane or typhoon, for example, the height of the water may not be sufficient to impact with the raised structure. However, the force of the moving water impinging upon the piling system causes the pilings to shift and move or crack, under the tremendous hydrodynamic drag-load produced by the hydrodynamic flow of water on and around the pilings. To date the only solutions to this problem have been to use larger, longer and more expensive pilings and/or use exotic and expensive piling materials. Lateral bracing between pilings and grading berms across coastal and flood plane constructions have had only minimal success. These are the only known means that have been employed to reduce the hydrodynamic drag load on piling foundations.

Thus, in accordance with this inventive concept, a need has been recognized in the state of the art for a cost-effective means utilizing hydrodynamic principles to extend the useful life of pilings in flowing waters.

OBJECTS AND SUMMARY OF THE INVENTION

An object of the invention is to provide a load reduction device for pilings in flowing fluid.

Another object of the invention is to provide devices mounted on pilings and utilizing hydro-dynamic principles to reduce the load imposed by flowing fluid on the pilings.

Another object of the invention is to provide a bi-directionally tapered hydrodynamic foil device mounted on pilings to reduce the fluid load created by flowing fluid on the pilings by at least two hundred percent.

Another object of the invention is to provide a self-orienting device in flowing fluid requiring no external power source to reduce flow drag on pilings.

Another object of the invention is to provide bi-directionally tapered hydrodynamic foil devices capable of being retrofitted on pilings to reduce the load imposed by flowing fluid on the pilings.

Another object of the invention is to provide mass-produced, cost-effective, devices mounted on pilings to reduce the load created by flowing fluid.

Another object of the invention is to provide cost-effective light-weight, flow-reduction devices mounted on pilings using vane-guide structures as bearing surfaces to eliminate parts and maintenance otherwise required of conventional bearing structures.

Another object of the invention is to provide a load reduction device mounted on pilings having non-uniform external surfaces and other shapes than round.

Another object of the invention is to provide flow-reduction devices mounted on pilings formed in a variety of shapes, sizes, lengths and colors.

These and other objects of the invention will become more readily apparent from the ensuing specification when taken in conjunction with the appended claims.

Accordingly, the invention is a device to reduce load created by flowing fluid on a piling. A bi-directionally tapered hydrodynamic foil has a traverse tube sized to fit around a piling in a spaced-apart relationship, and has a tapered leading vane portion located on one side of the traverse tube and extending to diametrically opposed opposite sides of the tube. The hydrodynamic foil additionally is provided with a tapered trailing vane portion located on the opposite side of the traverse tube as the tapered leading vane, and the tapered leading vane portion has a leading edge. The tapered trailing vane portion has an extended tapered shape of greater lateral area than the tapered leading vane portion to orient the leading edge of the tapered leading vane portion into the direction of flow of fluid flowing on the piling. Upper and lower collars engage the piling and contact the traverse tube to support and guide the bi-directionally tapered hydrodynamic foil during rotation around a longitudinal axis of the piling.

DESCRIPTION OF THE PREFERRED EMBODIMENTS

Figure 1:
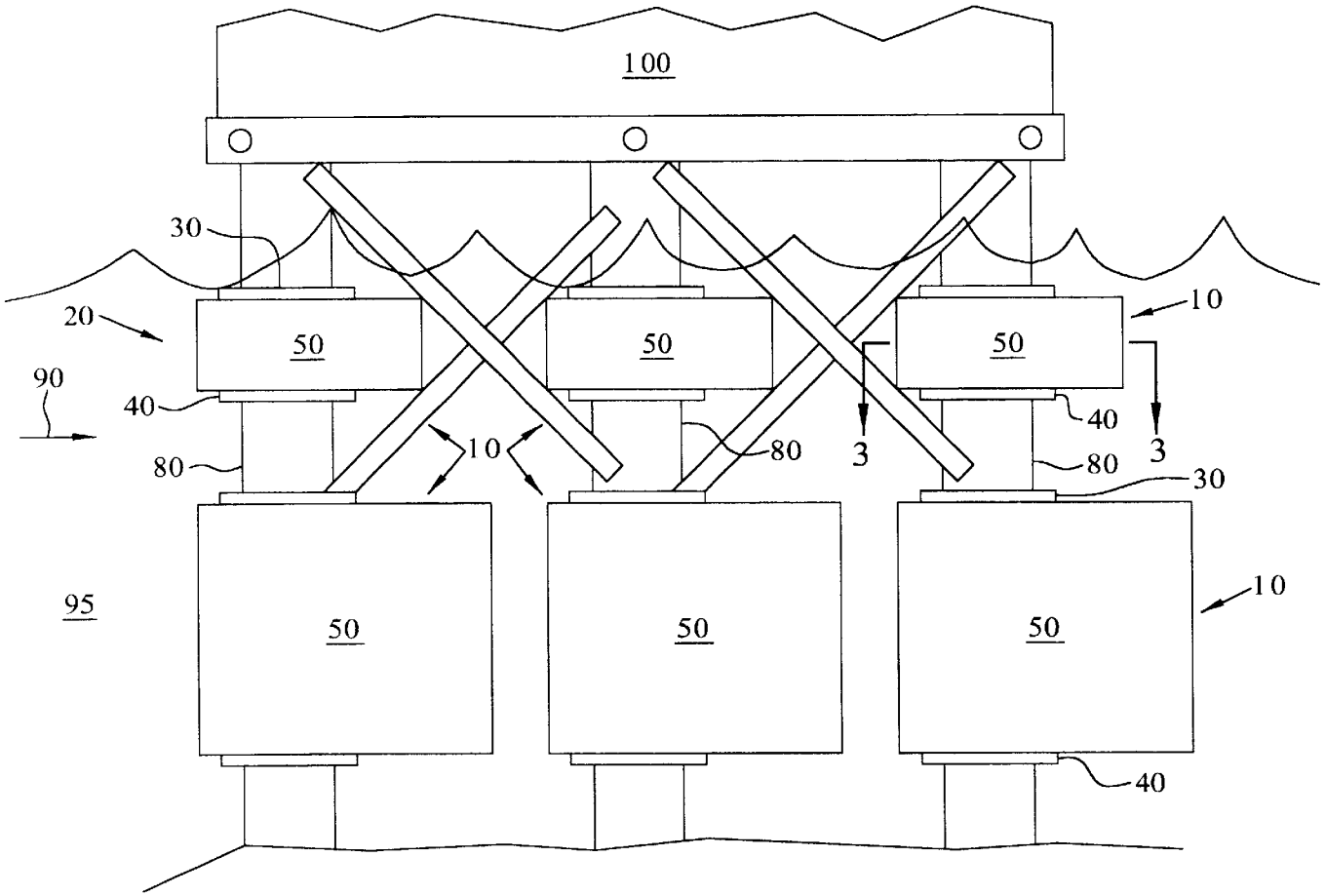
FIG. 1 is an isometric, schematic representation of dynamic load reduction devices of the invention mounted on pilings to reduce the drag loads created by flowing water.

Referring to FIGS. 1, several dynamic load reduction devices 10 of this invention are mounted on pilings 80 to reduce the effects of flowing fluid, shown as arrow 90, such as water 95 that impinges on pilings 80. Flowing water 90 caused by waves, tidal action, rivers, streams, etc., creates forces, or loads that stress exposed pilings 80 and can eventually cause failure in them. Load reduction devices 10, shown in two different exemplary sizes, are a cost effective means to dramatically reduce the drag forces imparted to pilings 80 that are exposed to flowing water 90 to increase their survivability and the structures 100 attached to and supported by them. Load reduction devices 10 can reduce the loads on pilings 80 attributed to flowing water by at least two hundred percent for a given set of hydrodynamic flow conditions in the realm of water-flow rates where failure of pilings is likely to occur.

Figure 2:
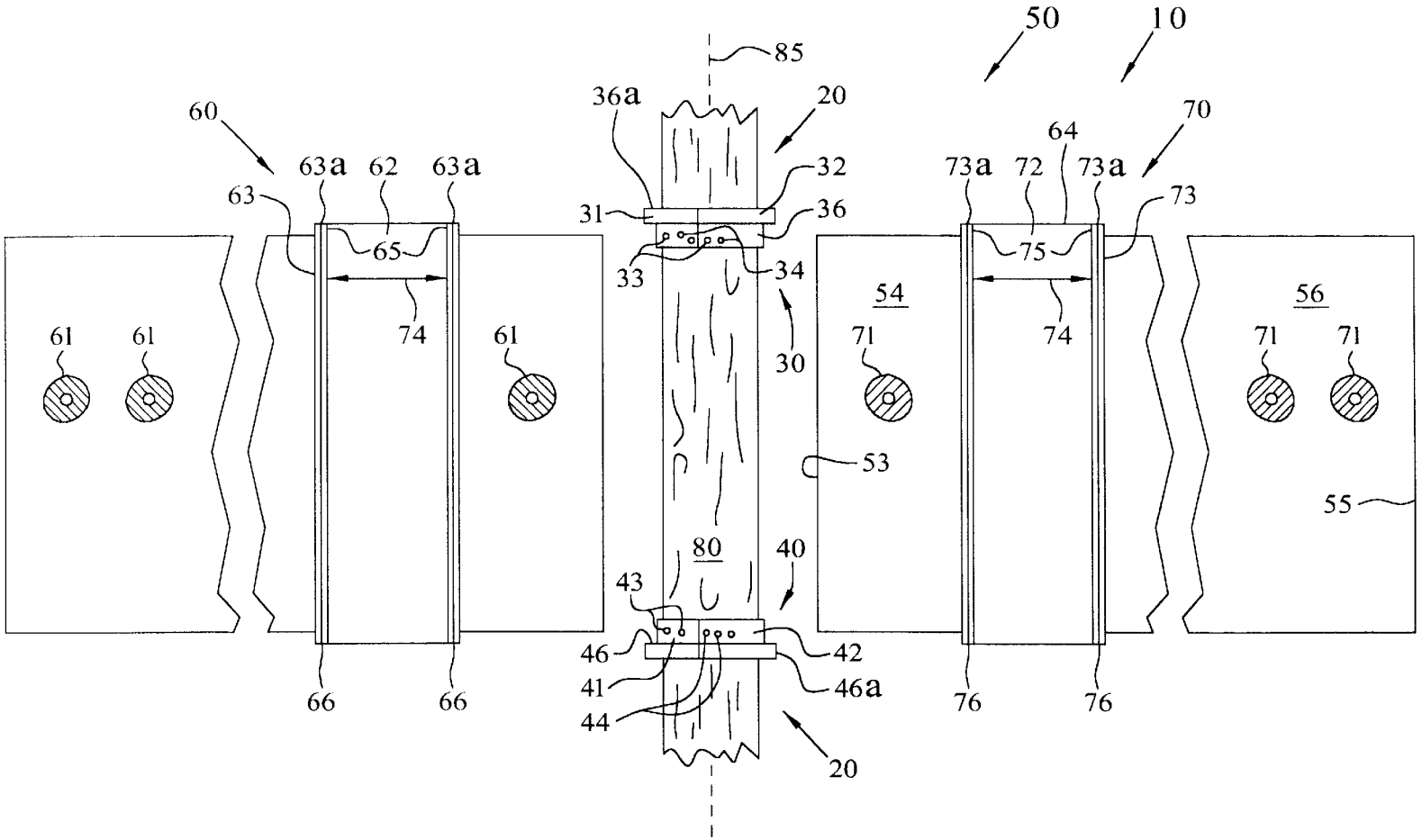
FIG. 2 is an exploded view of a dynamic load reduction device of the invention showing details of upper and lower guide collars and mating halves of the bi-directionally tapered hydrodynamic foil.
Figure 3:
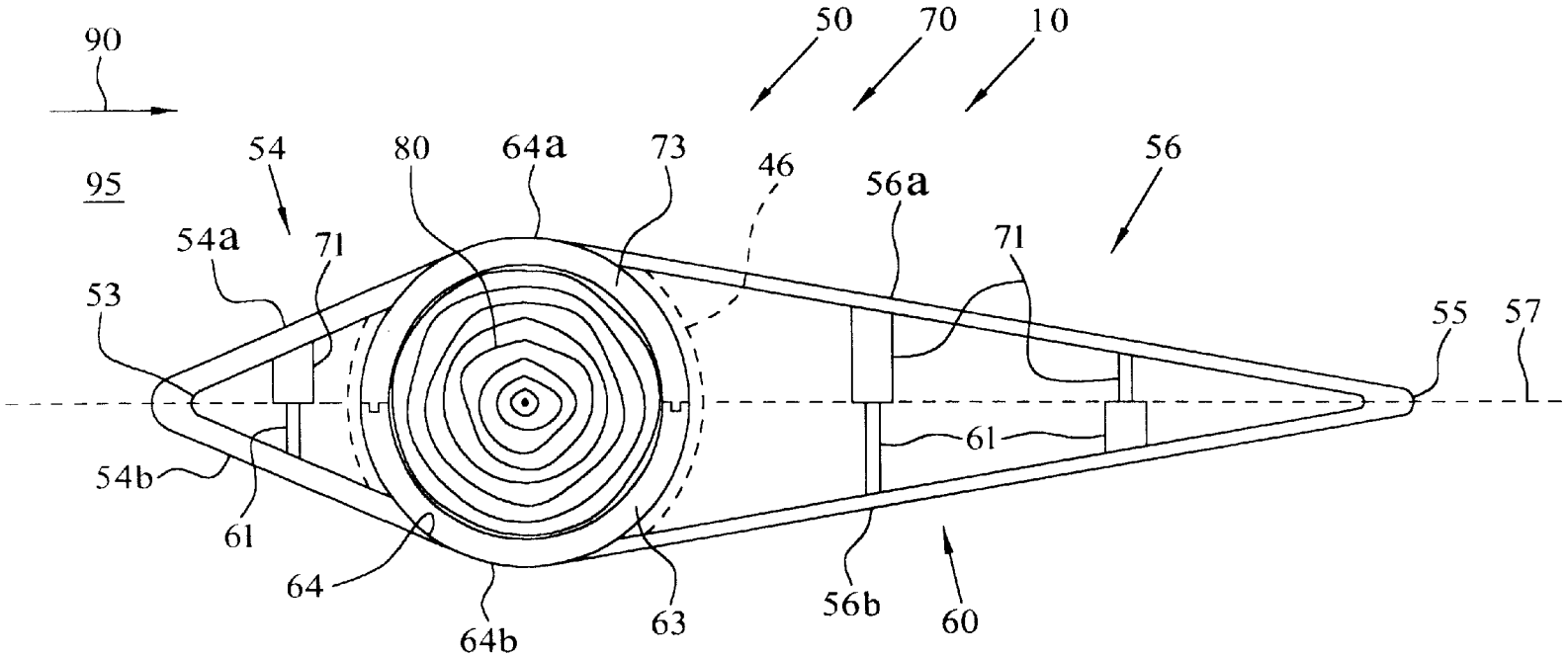
FIG. 3 is a cross-sectional top view of a dynamic load reduction device of the invention taken generally along line 3—3 in FIG. 1 showing details of the interconnection of the halves of the bi-directionally tapered hydrodynamic foil.

Referring additionally to FIGS. 2 and 3, load reduction device 10 has supports 20 including an upper guide collar 30 and lower guide collar 40 connected to piling 80. Upper guide collar 30 can be made from two semicircular parts 31 and 32 that are connected to an upper part of piling 80 by fasteners 33 such as screws, nails, or the like that extend through holes 34 and into piling 80. Semicircular parts 31 and 32 that are connected to piling 80 via fasteners 33 form a outwardly facing annular guide surface 36 on upper guide collar 30 and an outwardly extending rim 36*a* that extends radially outwardly from longitudinal axis 85 of piling 80. Lower guide collar 40 is made from two semicircular parts 41 and 42 that are connected to piling 80 by fasteners 43, such as screws, nails, etc., that extend through holes 44 and into piling 80. Semicircular parts 41 and 42 that are connected to piling 80 via fasteners 43 extending through holes 44 form a continuous, upwardly facing annular bearing surface 46 extending radially outwardly on a rim 46*a* from longitudinal axis 85 of piling 80.

A bi-directionally tapered hydrodynamic foil 50 of load reduction device 10 is mounted on guide collars 30 and 40 of supporting section 20 to rotate about longitudinal axis 85 and align load reduction device 10 with flow 90 of ambient water 95. Bi-directionally tapered hydrodynamic foil 50 includes mating halves 60 and 70 that are connected together with interlocking members 61 and 71. Interlocking members 61 and 71 can be a wide variety of male and female elements mounted on or cast as part of mating halves 60 and 70. Interlocking members 61 and 71 are securely connected to each other when they are brought adjacent each other and are forcefully pressed toward one another until they snap together in a mutually engaging relationship, for example.

Semi-circular openings 62 and 72 are formed in semi-cylindrical portions 63 and 73 in mating halves 60 and 70, respectively. When mating halves 60 and 70 are secured together via interlocking members 61 and 71, mating tongue-and-groove parts 63*a*, 73*a* in semi-cylindrical portions 63 and 73 engage to form an elongate traverse tube 64. Traverse tube 64 extends from top to bottom of halves 60 and 70 on the inside of hydrodynamic foil 50. Tube 64 has a diameter 74 larger than the overall diameter of piling 80 including its roughness, irregularities and small protuberances that are routinely found on wooden pilings. The larger diameter 74 maintains a spaced apart relationship with respect to piling 80. This spaced apart relationship allows unimpeded rotation and alignment with flowing water 90 by bi-directionally tapered hydrodynamic foil 50 on collars 30 and 40 over the often irregularly shaped outer contours on many wooden pilings 80.

Mating halves 60 and 70 have top follower surfaces 65 and 75 located in the inside of the top end of traverse tube 64 to come in contact with and be guided for rotation about piling 80 by outwardly facing annular guide surface 36. Outwardly extending annular rim 36*a* of upper guide collar 30 extends past tube 64 to prevent bi-directionally 11 tapered hydrodynamic foil 50 from sliding up past upper guide collar 30.

Mating halves 60 and 70 additionally have bottom follower surfaces 66 and 76 located on the bottom end of traverse tube 64 to bear, or rest on upwardly facing annular bearing surface 46 of lower guide collar 40. The contacts between follower surfaces 65, 75 and guide surface 36 and follower surfaces 66, 76 and bearing surface 46 are relatively low frictional contacts, and, accordingly, allow rotational sliding displacements in opposite directions between the follower surfaces and the guide and bearing surfaces. As a result, hydrodynamic foil 50 of load reduction device 10 is free to rotate about longitudinal axis 85 on piling 80. Thus, the relatively narrow, leading edge 53 of tapered leading vane portion 54 of halves 60 and 70 of bi-directionally tapered hydrodynamic foil 50 can be rotated to point into the direction water 95 is coming from. This rotation simultaneously places a trailing edge 55 of a tapered trailing vane portion 56 trailing behind in the direction of flow. Leading edge 53 and tapered leading vane portion 54 are located on one side of tube 64, and tapered trailing vane portion 56 is located on the opposite side of tube 64 as tapered leading vane portion 54. Both tapered leading vane portion 54 and tapered trailing vane portion 56 extends to diametrically opposed opposite sides 64*a* and 64*b* of traverse tube 64.

Tapered leading vane portion 54 of bi-directionally tapered hydrodynamic foil 50 is located forward of piling 80 and its relatively narrow leading edge 53 and tapered cross section reduce the force of flowing fluid 90 on piling 80. By appropriate selection of materials and the thickness of their walls for example, construction of mating halves 60 and 70 is such as to make the masses of tapered leading vane portion 54 and tapered trailing vane portion 56 roughly equal. Tapered leading vane portion 54 is made to have oppositely facing lateral surface areas 54*a*, 54*b* smaller than the oppositely facing lateral areas 56*a*, 56*b* of tapered trailing vane portion 56 rearward of piling 80. This distribution of lateral areas (or horizontally facing pressure areas) 54*a*, 54*b*, 56*a*, 56*b* creates a weather vane-like effect that places the center of mass forward of the center of horizontal pressure during hydrodynamic flow. In a synergistic manner, this arrangement causes bi-directionally tapered hydrodynamic foil 50 to orient itself with fluid-flow 90 and, therefore, to reduce hydrodynamic drag on piling 80.

Tapered leading vane portion 54 and tapered trailing vane portion 56 of bi-directionally tapered hydrodynamic foil 50 are fabricated in essentially shell-shaped mating halves 60, 70. These mating halves 60, 70 have virtually identical mirror-image cross-sectional shapes with respect to their longitudinal axis 57. Consequently, the flow of flowing fluid 90 is equal about both of the identically shaped mating halves 60, 70 to ensure that leading edge 53 of bi-directionally tapered hydrodynamic foil 50 points directly into flowing water 95.

Furthermore, the tapered foil shape of tapered leading vane portion 54 and tapered trailing vane portion 56 has a lower coefficient of drag as compared to the round shaped piling 80 or rectangular shaped piling 80" (see FIG. 5) exposed to flowing fluid 90. For example, flow studies of air around circular pilings have yielded a drag coefficient of about 0.47. The drag coefficient for load reduction device similar in shape to that disclosed herein has a maximum drag coefficient of around 0.024. The reduction in drag coefficient translates directly into a force reduction of between two hundred and nineteen hundred percent when the shape of load reduction device 10 of this invention is used around a circular piling 80. The reduced drag force, or load provided by bi-directionally tapered hydrodynamic foil 50 on such pilings increases the survivability of pilings, piling foundations, and the structures they support. The thin leading edge 53 and tapered shapes of both tapered leading vane portion 54 and tapered trailing vane portion 56 being aligned with flowing water 90 synergistically reduce drag. This drag reduction is greater than some contemporary vane structures having blunt or merely rounded frontal surfaces that face into the flow of water and a trailing structure that points downstream, see, for example U.S. Pat. Nos. 4,171,674 and 4,365,574. For a multitude of civilian and military applications the tremendous reductions in load attributed to drag from flowing water on the piling members and the subsequent increase in survivability will be of significant interest to assure survival of piling structures in flood and high-hazard coastal areas worldwide.

Load reduction device 10 can be made to have longer hydrodynamic profiles of greater than ten-to-one, where the numeral one designates the dimension of the diameter of the piling and ten refers to its length. Load reduction device 10 is not dependent on buoyancy to perform effectively, and it has relatively low mass to reduce mass loading and the possibility of destructive changes in momentum that might otherwise pull a piling structure over to collapse.

Load reduction device 10 can be mounted on pilings below the high waterline to reduce loading at high tides that might coincide with storm conditions. When load reduction device 10 is used in this way, it can be made to present an ornamental or artistic flair, such as making it in the form and coloration of a flamingo or other appealing object (not shown). In order to retain its load reduction capabilities, the more visually appealing flamingo-shaped bi-directionally tapered hydrodynamic foil 50 would have to have a greater surface area at the tail (tapered trailing vane portion 56 at the rear of a piling) than the head and neck part (tapered leading vane portion 54 forward of the piling). The width profile (taken from a perspective above and looking-down) of the ornamental structure additionally must be balanced and the tail and head-neck parts should weigh about the same.

Load reduction device 10 of this invention is particularly adapted to protecting marine pilings. Marine pilings usually are made of wood and have large variations on external diameter throughout their length as well as extreme variability in surface roughness. In addition, adaptations of load reduction device 10 can accommodate pilings that are tapered or square (or other shapes) to provide for highly satisfactory reduction of dynamic flow loads.

Figure 4:
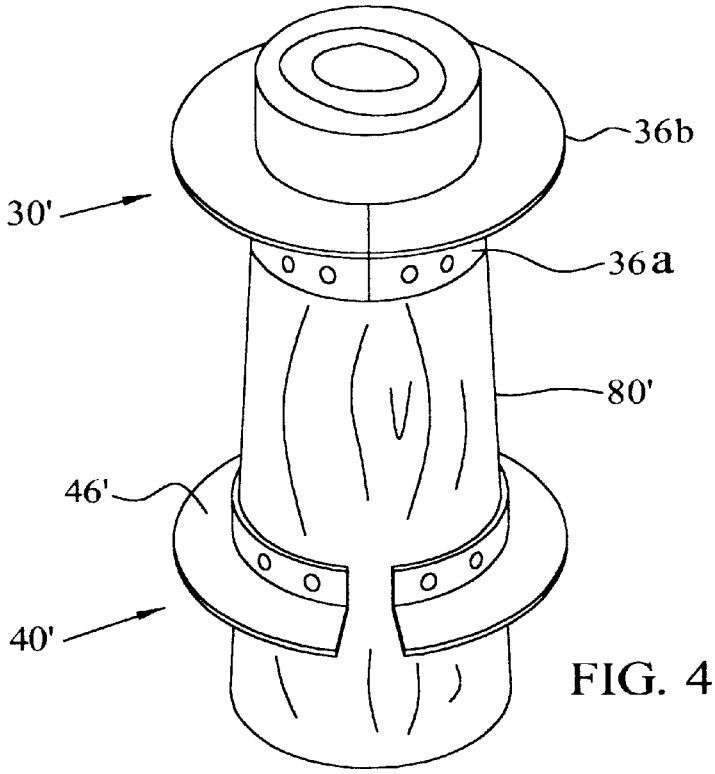
FIG. 4 is a schematic representation of upper and lower guide collars adapted for tapered support structure.

Referring to FIG. 4, load reduction device 10 can protect tapered pilings 80' from loading imposed by flowing water as well as the essentially cylindrically-shaped conventional pilings 80. For this application upper guide collar 30' is made to be smaller than lower guide collar 40' to fit about tapered piling 80'. Upper guide collar 30' and lower guide collar 40' respectively have an outwardly facing annular guide surface 36*a* and rim 36*b* and upwardly facing annular bearing surface 46' to respectively guide and support bi-directionally tapered hydrodynamic foil 50 as described above.

Figure 5:
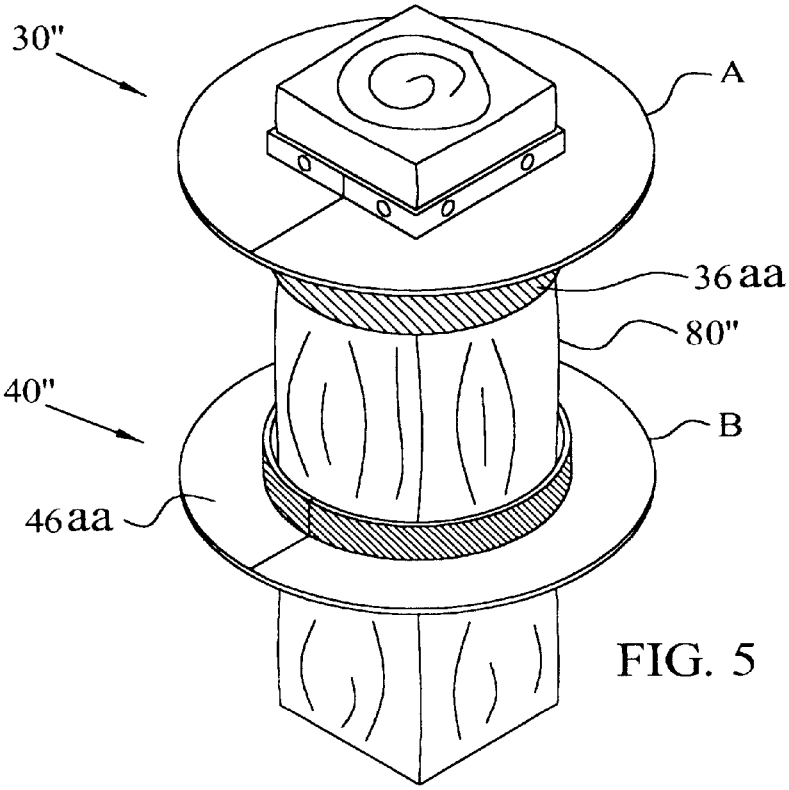
FIG. 5 is a schematic representation of upper and lower guide collars adapted for non-rounded support structure, such as square.

Referring to FIG. 5, load reduction device 10 of this invention can protect square, triangular, etc., pilings 80" from loading imposed by flowing water as well. Upper guide collar 30" and lower guide collar 40" can be made with larger radially outwardly extending parts A and B that fit about square or other shaped pilings 80". Upper guide collar 30" and lower guide collar 40" respectively have a larger outwardly facing annular guide surface 36*aa* and a larger upwardly facing annular bearing surface 46*aa* to respectively guide and support bi-directionally tapered hydrodynamic foil 50.

The materials selected for fabrication of upper and lower guide collars 30 and 40 of supports 20 and mating halves 60 and 70 of bi-directionally tapered hydrodynamic foil 50 are numerous and should not be construed as limiting. For examples, collars 30 and 40 could be made from plastic or aluminum and secured into place about the piling using a number of different fasteners 33, 43. Mating halves 60 and 70 could be shell-shaped and injection molded from a number of high-strength composite thermo-set or thermoplastic materials in numerous colors and states of translucency. Optionally, collars 30 and 40 each could be made from a suitable length of an elongate strip of a tough, flexible material. As such it could be wrapped about differently sized pilings 80 and nailed or stapled in place to present sufficiently outwardly extending bearing surfaces to guide and support bi-directionally tapered hydrodynamic foil 50. Obviously, one having ordinary skill in the art to which this invention pertains can select materials having properties of suitable strength and corrosion resistance that are especially suitable for use in the intended marine environment.

Having the teachings of this invention in mind, modifications and alternate embodiments of load reduction device 10 may be adapted without departing from the scope of the invention. Its uncomplicated, compact design lends itself to numerous modifications to permit its reliable use in hostile marine environments as well as high wind conditions where such winds are found to affect long-term reliability or otherwise interfere with operational requirements.

The disclosed components and their arrangements as disclosed herein, all contribute to the novel features of this invention. Load reduction device 10 is a user friendly tool that can be installed by unskilled workers after minimal instruction to provide a relatively inexpensive yet effective way to extend the useful life of pilings in different environments where water is flowing. Therefore, load reduction device 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A device to reduce load created by flowing fluid on a piling comprising:

a bi-directionally tapered hydrodynamic foil having a traverse tube sized to fit around a piling in a spaced-apart relationship with respect to said piling, said hydrodynamic foil having a tapered leading vane portion located on one side of said traverse tube and extending to diametrically opposed sides thereof, said hydrodynamic foil having a tapered trailing vane portion located on the opposite side of said traverse tube as said tapered leading vane portion, said tapered leading vane portion having a leading edge and said tapered trailing vane portion having an extended tapered shape of greater lateral area than said tapered leading vane portion to orient said leading edge of said tapered leading vane portion into the direction of flow of fluid flowing on said piling; and upper and lower collars secured to said piling to contact said traverse tube, said upper and lower collars supporting and guiding said bi-directionally tapered hydrodynamic foil during rotation around a longitudinal axis of said piling to maintain said spaced-apart relationship between said traverse tube and said piling.

2. The device of claim 1 whereby said flowing fluid is comprised of flowing water and orienting said leading edge of said leading tapered vane portion into the direction of said flowing fluid reduces hydrodynamic loading on said piling.

3. The device of claim 2 wherein said bi-directionally tapered hydrodynamic foil is comprised of two shell-shaped mating halves having mating tongue-and-groove edges secured together by interlocking members.

4. The device of claim 3 wherein said bi-directionally tapered hydrodynamic foil is supported at the bottom of said tube on an upwardly facing annular bearing surface of said lower guide collar and is guided for rotational displacement about a longitudinal axis of said piling by an outwardly facing guide surface of said upper guide collar to maintain said spaced-apart relationship between said traverse tube and said piling.

5. The device of claim 4 wherein said bi-directionally tapered foil reduces the load created by flowing fluid on said piling by at least two hundred percent as compared to the load created by said flowing fluid on said piling alone.

6. The device of claim 5 wherein said shell-shaped mating halves are thicker at said leading tapered vane portion as compared to said trailing tapered vane portion to make them weigh about the same.

7. The device of claim 6 wherein said upper and lower guide collars and said hydrodynamic foil are fabricated from lightweight, strong, and non-corrosive materials for use in water.

8. The device of claim 7 wherein said upper and lower guide collars are configured to accommodate a cylindrically shaped piling.

9. The device of claim 7 wherein said upper and lower guide collars have tapered rounded portions shaped to accommodate a portion of a tapered piling.

10. The device of claim 7 wherein upper and lower guide collars have tapered flat portions shaped to accommodate a portion of a square piling.

* * * * *